US005271827A

United States Patent [19]

Woebcke

[11] Patent Number: 5,271,827

[45] Date of Patent: Dec. 21, 1993

[54] PROCESS FOR PYROLYSIS OF HYDROCARBONS

[75] Inventor: Herman N. Woebcke, Barnstable, Mass.

[73] Assignee: Stone & Webster Engineering Corp., Boston, Mass.

[21] Appl. No.: 902,913

[22] Filed: Jun. 24, 1992

Related U.S. Application Data

[62] Division of Ser. No. 619,740, Nov. 29, 1990, Pat. No. 5,147,511.

[51] Int. Cl.[5] ..... C10G 9/14; C07C 4/04

[52] U.S. Cl. ..... 208/132; 585/648; 585/650

[58] Field of Search ..... 208/132; 585/648, 650

[56] References Cited

U.S. PATENT DOCUMENTS

| | | | |
|---|---|---|---|
| 2,151,386 | 3/1939 | De Florez | 196/110 |
| 2,346,345 | 4/1944 | Angell | 122/356 |
| 2,898,892 | 8/1959 | Campbell et al. | 122/356 |
| 3,407,789 | 10/1968 | Hallee et al. | 122/356 |
| 3,487,121 | 12/1969 | Hallee | 585/652 |
| 3,763,261 | 10/1973 | Sato et al. | 585/332 |
| 3,910,347 | 10/1975 | Woebcke | 165/142 |
| 4,268,375 | 5/1981 | Johnson et al. | 208/72 |
| 4,318,800 | 3/1982 | Woebcke et al. | 208/127 |
| 4,356,151 | 10/1982 | Woebcke et al. | 422/145 |
| 4,433,193 | 2/1984 | Koppel et al. | 585/752 |
| 4,457,364 | 7/1984 | DiNicolantonio et al. | 165/134.1 |
| 4,492,624 | 1/1985 | Johnson et al. | 208/78 |
| 4,496,381 | 1/1985 | Norenburg | 62/30 |
| 4,615,795 | 10/1986 | Woebcke et al. | 208/72 |
| 4,732,740 | 3/1988 | Woebcke et al. | 422/193 |

FOREIGN PATENT DOCUMENTS

| | | |
|---|---|---|
| 0298624 | 1/1989 | European Pat. Off. . |
| 2647804 | 12/1990 | France . |
| 61-183389 | 8/1986 | Japan . |

*Primary Examiner*—Mark L. Bell
*Assistant Examiner*—Walter D. Griffin
*Attorney, Agent, or Firm*—Hedman, Gibson & Costigan

[57] ABSTRACT

An improved hydrocarbon pyrolysis process and apparatus for the production of ethylene comprising a novel furnace comprised of an unfired superheater radiant section and a fired radiant section, adiabatic tube reactor and quench boiler is provided.

10 Claims, 4 Drawing Sheets

PROCESS FOR PYROLYSIS OF HYDROCARBONS

This is a divisional of application Ser. No. 07/619,740, filed Nov. 29, 1990, now U.S. Pat. No. 5,147,511.

FIELD OF THE INVENTION

This invention relates to a process and apparatus for the production of olefins. More particularly, this invention relates to a process and apparatus for the production of ethylene and other light olefins from hydrocarbons.

BACKGROUND OF THE INVENTION

The petrochemical industry has long used naturally forming hydrocarbon feedstocks for the production of valuable olefinic materials, such as ethylene and propylene. Ideally, commercial operations have been carried out using normally gaseous hydrocarbons such as ethane and propane as the feedstock. As the lighter hydrocarbons have been consumed and the availability of the lighter hydrocarbons has decreased, the industry has more recently been required to crack heavier hydrocarbons. Hydrocarbons such as naphtha, atmospheric gas oils (AGO) and vacuum gas oils (VGO) which have higher boiling points than the gaseous hydrocarbons are being used commercially.

A typical process for the production of olefins from hydrocarbon feedstocks is the thermal cracking process. In this process, hydrocarbons undergo cracking at elevated temperatures to produce hydrocarbons containing from 1 to 4 carbon atoms, especially the corresponding olefins.

At present, there are a variety of processes available for cracking heavier hydrocarbons to produce olefins. Typically, the hydrocarbon to be cracked is delivered to a furnace comprised of both a convection and radiant zone. The hydrocarbon is initially elevated in temperature in the convection zone to temperatures below those at which significant reaction is initiated; and thereafter is delivered to the radiant zone wherein it is subjected to intense heat from radiant burners. An example of a conventional furnace and process is shown in U.S. Pat. No. 3,487,121 (Hallee).

Illustratively, process fired heaters are used to provide the requisite heat for the reaction. The feedstock flows through a plurality of coils within the fired heater, the coils being arranged in a manner that enhances the heat transfer to the hydrocarbon flowing through the coils. The cracked effluent is then quenched either directly or indirectly to terminate the reaction. In conventional coil pyrolysis, dilution steam is used to inhibit coke formation in the cracking coil. However, in the production of the olefins from hydrocarbon feedstocks the generation of coke has been a problem regardless of the process used. Typically, the cracking reaction will cause production of pyrolysis fuel oil, a precursor to tar and coke materials which foul the equipment. A further benefit of steam dilution is the inhibition of the coke deposition in the heat exchangers used to rapidly quench the cracking reaction.

More recently, the thermal cracking process has been conducted in an apparatus which allows the hydrocarbon feedstock to pass through a reactor in the presence of steam while employing heated particulate solids as the heat carrier. After cracking, the effluent is rapidly quenched to terminate the cracking reactions, the solids being separated from the effluent, preheated and recycled.

In the past, when light hydrocarbons, ethane to naphtha, were used to produce olefins in the thermal cracking process these hydrocarbons could be cracked with dilution steam in the range of 0.3 to 0.6 pounds of steam per pound of hydrocarbon. Heavy hydrocarbons require from about 0.7 to 1.0 pounds of dilution steam per pound of hydrocarbon. As a general proposition, the higher quantities of dilution steam are needed for heavier hydrocarbons to obtain the desired partial pressure of the hydrocarbon stream that is required to suppress the coking rates in the radiant coils during thermal cracking. Correlatively, the dilution steam requirement demands increased furnace size and greater utility usage.

It is well-known that in the process of cracking hydrocarbons, the reaction temperature and reaction residence time are two primary variables affecting severity, conversion and selectivity. Severity is related to the intensity of the cracking reactions. It is related to the reaction velocity constant of n-pentane in reciprocal seconds and the time (t) in seconds. Conversion is the measure of the extent to which the feed has been pyrolyzed (% to which n-pentane would have decomposed under the history of the feed). Conversion of commercial hydrocarbon feeds has been related to the conversion of normal pentane (c) by the following expression:

$$Kt = \ln [c/(100-c)]$$

wherein K is the reaction velocity constant of normal pentane in reciprocal seconds, doubling about every 20° F.; and t is the reaction time in seconds.

Selectivity is the degree to which the converted products constitute ethylene. Selectivity is generally expressed as a ratio of olefin products to fuel products.

At low severity, selectivity is high, but because conversion is low, it is uneconomical to utilize a low severity operation. Low severity operation is conducted generally at temperatures between 1200° and 1400° F. and residence times between 2000 and 10000 milliseconds. High severity and high conversion may be achieved at temperatures between 1500° F. and 2000° F. However, selectivity is generally poor at temperatures above 1500° F. unless the high severity reaction can be performed at residence times below 200 milliseconds, usually between 20 and 100 milliseconds. At these very low residence times selectivities between 2.5 and 4.0 pounds of ethylene per pound of methane can be achieved, and conversion is generally over 95% by weight of feed. High severity operation, although preferred, has not been employed widely in the industry because of the physical limitations of conventional fired reactors. One of the limitations is the inability to remove heat from the product effluent within the allowable residence time parameter. For this reason, most conventional systems operate at conditions of moderate severity, temperatures being between 1350° and 1550° F. and residence times being between 200 and 500 milliseconds. Although conversion is higher than at the low severity operation, selectivity is low, being about two pounds of ethylene per pound of methane. But because conversion is higher the actual yield of ethylene is greater than that obtained in the low severity operation.

The yield of pyrolysis fuel oil (PFO) increases with conversion. The rate of formation of PFO increases dramatically above a critical conversion level, where the critical conversion level is a function of feed quality. It occurs at about 75% conversion of heavy naphtha and 85% conversion for lighter naphtha.

By using low residence time at high severity conditions, it is possible to achieve selectivities of about 3:1 or greater. As a result, a number of processes have been developed which offer high severity thermal cracking. For example, furnaces have been developed which contain a large number of small tubes wherein the outlet of each tube is connected directly to an individual indirect quench boiler. This process has the disadvantage of being capital intensive in that the quench boiler is not common to a plurality of furnace tube outlets. Thus, the number of quench boilers required increases. Further, the high temperature waste heat must be used to generate low temperature, high pressure steam which is not desirable from a thermal efficiency viewpoint. Finally, high flue gas temperatures must be reduced by generation of steam in the convection section of the heater, again limiting the flexibility of the process.

In Hallee, U.S. Pat. No. 3,407,789, the furnace comprised a convection preheat zone and a radiant conversion zone or cracking zone. In the radiant section, the conduits or tubes through which the fluid to be treated passes are of relatively short length and small-diameter and of low pressure drop design. The quenching zone is close coupled to the reaction products outlet from the furnace and provides rapid cooling of the effluent from the reaction temperature down to a temperature at which the reaction is substantially stopped and can be cooled further by conventional heat exchange means.

Thus, as reaction time is reduced. it is necessary to increase the process temperature (P) in order to maintain a desired conversion level. It is generally accepted that selectivity and yield increase as residence time is reduced. Industrial plants built to reduce residence times to about 100 milliseconds, however, have run into several obstacles. The run lengths, the period between coil decokings, are reduced from several months to several days. In addition, capital and fuel costs have both increased.

The relations available to the reactor designer to reduce reaction time are summarized by the following equation:

$$t = \frac{D}{4} \cdot \frac{H}{Q} \cdot d$$

where

D=coil i.d. measured in feet

H=heat absorbed in the radiant reactor in BTU/lb d=density of process fluid in lb/ft$^3$ Q=heat flux in BTU/(sec ft$^2$)

For conventional plants there is little opportunity to reduce D, H or d. D is set by practical limitations in the fabrication of long heat resistant alloy tubes. H is controlled by nature and is equal to the amount of energy required to achieve a given feed conversion. The process fluid density, d, is primarily set by the minimum practical pressure at the coil outlet. Increasing the remaining variable Q, heat flux, increases the difference between metal (M) and process (P) temperatures.

It has already been pointed out that reducing t requires an increase in P. Thus, reducing t increases both M and P, the increase in M being compounded. Increasing either M or P increases the rate of coke deposition. Both of these factors are further exacerbated by the common industrial practice of maximizing conversion in the radiantly heated coil, and by minimizing conversion in the tie line between the coil outlet and the quench boiler inlet.

Increasing Q requires an increase in the temperature of the radiant firebox, thus increasing the BTU of fuel per BTU of H, raising fuel costs per pound of olefin produced.

It would therefore satisfy a long felt need in the art if a pyrolysis system could be provided which maintains a 2 to 3 month run length at improved thermal efficiency and lower capital costs with a significant reduction in t.

Surprisingly, applicants have found that contrary to the teachings of the prior art that conditions used for conversion of normally liquid hydrocarbons below 10 to 20% have little or no effect on olefin yield or selectivity; that the yield of pyrolysis fuel oil, a precursor of coke, increases rapidly above a critical severity, conversions of 65 to 75%; that the temperature profile used for reaction has no measurable influence on yield or selectivity provided the target conversion is reached in the same time and at the same pressure level; and that the maximum metal temperature at a given radiant firebox temperature can be reduced by decreasing the radiant beam length with little or no influence on reaction time at conversion levels above about 50 percent.

SUMMARY OF THE INVENTION

It is an object to the present invention to provide an improved pyrolysis process and apparatus for the production of ethylene.

It is also an object of the present invention to provide an improved pyrolysis process and apparatus for the production of ethylene wherein the radiantly heated coils are kept below a critical severity level.

It is a further object of the present invention to provide an improved pyrolysis process and apparatus for the production of ethylene where the pyrolysis process can be completed above the critical severity level under adiabatic conditions in the tie line between the radiant coil and quench boiler.

It is another object of the present invention to provide an improved pyrolysis process and apparatus for the production of ethylene at short residence times while reducing the temperature of the flue gas entering the convection section below conventional levels, below 1800° F.

It is still a further object of the present invention to provide an improved pyrolysis process and apparatus that will allow the transfer of heat radiantly to the tubes through which the process fluid passes while maintaining a lower flue gas temperature.

It is a further object of the present invention to provide an improved process and apparatus that will insure a controlled variation in flue gas temperature along the length of the pyrolysis coils.

It is still another object of the present invention to provide a furnace having a minimum amount of coil structure but with the capability to achieve the same conversion and yield of heavier conventional furnaces.

It is still another further object of the present invention to produce an improved pyrolysis process and apparatus which provides for reducing the pressure level at the outlet of the reaction system by reducing the high velocities used in the reactor to those practical in the quench boiler through a pressure recovery venturi located in the adiabatic reaction portion of the system.

The radiant furnace assembly of the present invention is comprised essentially of an unfired superheater zone and a fired radiant zone within the furnace structure, an adiabatic reactor downstream of the radiant zone and outside the furnace structure and an indirect quench apparatus close coupled downstream of the adiabatic reactor. Process coils extend from the superheater zone throughout the radiant zone to the adiabatic heater.

The radiant zone is fired by radiant burners and is reduced in width at the discharge end and may be configured with a tapered section at the discharge end. The upstream superheater section is preferably unfired, but may be provided with burners. Communication is provided between the radiant zone and the superheater zone to enable passage of the gases from the radiant burner to travel from the radiant zone to the superheater zone and ultimately through the convection section for discharge to the atmosphere.

The quench apparatus is comprised of an indirect heat exchanger having a venturi at or before the inlet that converts velocity to a pressure head. The cold side of the heat exchanger is contained in the interior of the structure with an annular cold side chamber surrounding the internal cold side.

In the cracking process, hydrocarbon feed at about 1200° F. and 0% conversion is heated and is delivered to the coil inlet located in the superheater zone. The feed is elevated in the radiant superheater zone to preheat temperatures in the range of 1325° F. by hot gases from the radiant zone. The superheater zone is designed and operated to maintain a flue gas temperature of about 1800° F.

The feed from the superheater zone passes into the radiant zone that is fired to about 2300° F. to heat the feed to about 1650° F. at a short residence time to effect from about 45 to about 65% conversion. Thereafter, the effluent from the radiant zone passes to the external adiabatic reactor for a residence time of less than about 20 milliseconds to continue the reaction to achieve 95% conversion. The quench boilers are immediately downstream of the adiabatic reactor and operate to quickly quench the reaction products to terminate the reactions.

DESCRIPTION OF THE DRAWINGS

The invention will be better understood when considered with the accompanying drawings wherein.

DESCRIPTION OF THE PREFERRED EMBODIMENT

Figure 2:
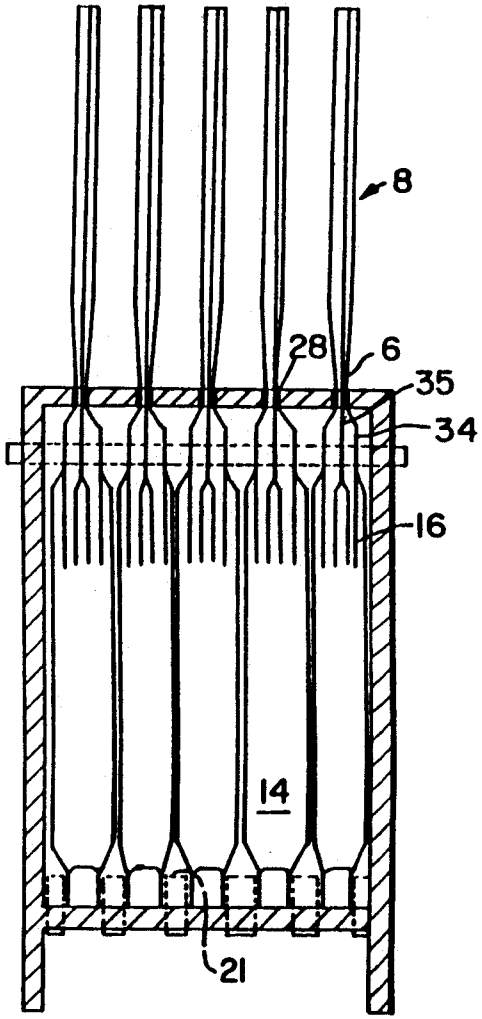
FIG. 2 is an elevational view through line 2—2 of FIG. 1.
Figure 1:
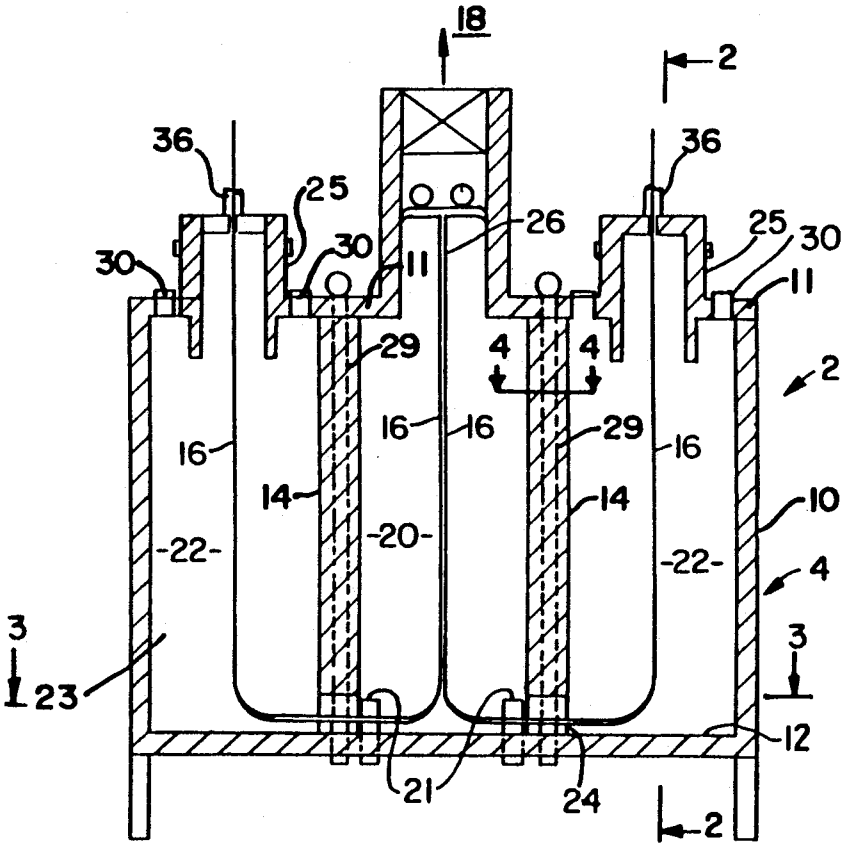
FIG. 1 is a sectional elevational view of the furnace apparatus of the present invention.
Figure 3:
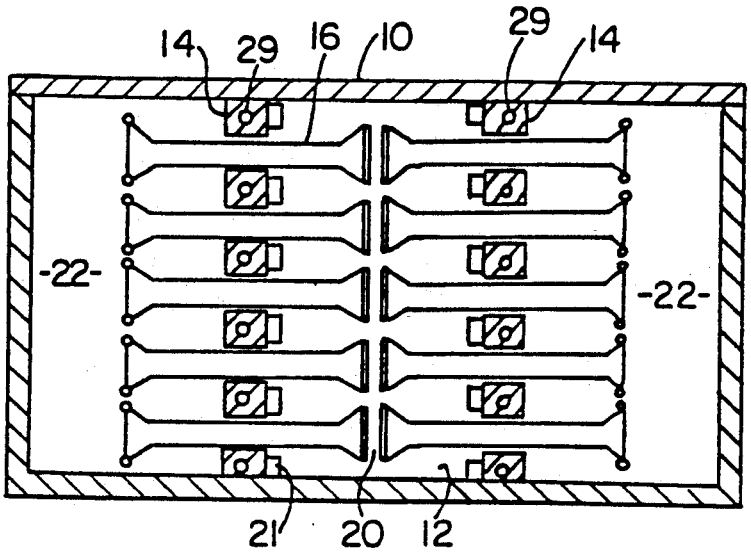
FIG. 3 is a plan view of FIG. 1 taken through line 3—3.
Figure 4:
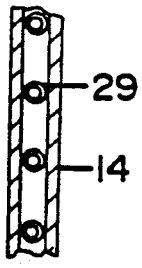
FIG. 4 is a partial plan view of FIG. 1 taken through line 4—4.
Figure 7:
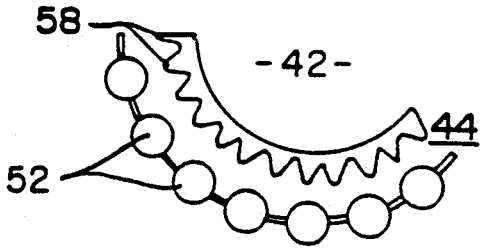
FIG. 7 is a partial plan view of FIG. 6 taken through line 7—7.

As seen in FIGS. 1, 2 and 3, the furnace 2 of the present invention is comprised essentially of a furnace structure 4, an external adiabatic reactor 6 and quench boilers 8.

The furnace 2 is comprised of outer walls 10, a roof 11, a floor 12, centrally disposed walls 14, a plurality of process coils comprising convection coils (not shown), radiant coils 16, and a flue gas outlet 18. The central walls 14 define an upstream superheater zone 20 and the combination of the centrally disposed walls 14 and outer walls 10 define a downstream radiant zone 22. In the preferred embodiment, the centrally disposed wall 14 is elevated above the floor 12 to provide an access opening 24 between the superheater zone 20 and the radiant zone 22. The convection coils are horizontally disposed in a convection section at the entry of the flue gas outlet 18 and extend to the furnace coil inlet 26 to form the radiant coils 16. The radiant coils 16 extend from the furnace coil inlet 26 through the superheater zone 20, the access opening 24 and radiant zone 22 to the coil furnace outlet 28.

Conventional burners 30 are arranged in an array at the top of each longitudinal side of the radiant zone 22 extending downwardly from roof 11. In a preferred embodiment, the top 25 of the radiant zone 22 may be configured to present a lateral side cross-section having a greater width at the bottom 23 than at the top 25 as shown in FIG. 1. Most preferably, in a furnace 2 thirty feet high, the bottom 23 of the radiant zone 22 can be eight feet wide and the top 25 only three and one half feet wide for the top five feet. It is also contemplated that the radiant zone 22 may be tapered with the taper beginning at a point about one-third from the roof 11. The radiant coils 16 are U-shaped and are centrally disposed within the superheater zone 20 and the radiant zone 22 to achieve maximum radiant heating efficiency. Auxiliary trim burners 21 are also provided.

The furnace 2 of the present invention is designed to experience temperatures of 2300° F. plus in the radiant zone 22 and 1775° F. plus in the superheater zone 20. The tube metal temperature in the radiant zone 22 and superheater zone 20 will be in the range of 1865° F. and 1325° F. respectively. It has been found that conventional fire brick can withstand the 2300° F. plus temperature that will occur in the radiant zone 22. Thus, the furnace walls can be constructed of materials conventionally used for radiant zones, convection zones and furnace flues.

In addition, the walls 14 are provided with reinforcement members 29, preferably in the form of 6 inch pipe that extend from the roof 11 to the bottom of the walls 14. The coil metal temperatures in the range of 1865° F. (radiant zone 22) and 1325° F. (superheater zone 20) require only conventional furnace tube metals.

Figure 5:
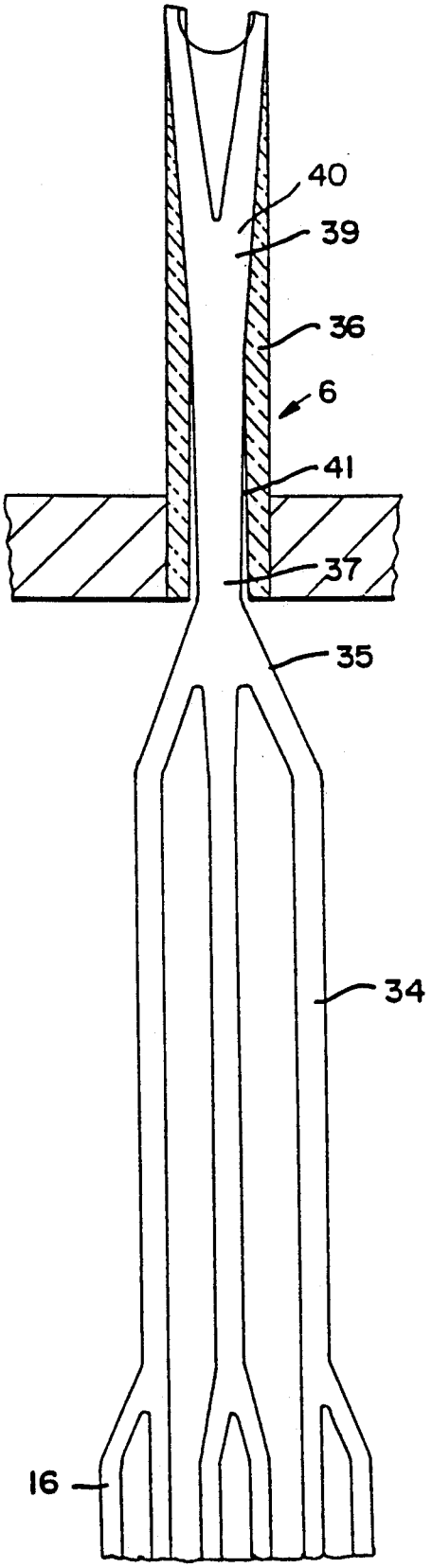
FIG. 5 is a sectional elevational view of a plurality of process coils manifolded at the entry of the adiabatic reactor.

Immediately downstream of the radiant zone 22 is the adiabatic reactor 6. As best seen in FIGS. 2 and 5, a plurality of coils 16 are manifolded into common conduits 34 in the radiant zone 22 and the conduits 34 are manifolded into a header 35 at the entry of the adiabatic reactor 6. The adiabatic reactor 6 can be variously configured, however conventional exterior insulation 36 surrounding the reactor 6 provides the adiabatic envelope required for the continued reaction of the process feed after exiting the furnace 2. The process fluid temperatures expected in the adiabatic reactor 6 range from about 1650° F. at the adiabatic reactor entry 38 to about 1625° F. at the adiabatic reactor outlet 40. The adiabatic reactor 6 is configured in the form of a venturi with an upstream section 37, a downstream section 39 and a throat 41. In a preferred embodiment, the venturi configuration reduces the hot product gas velocity from about 800 to about 250 ft/second.

Figure 6:
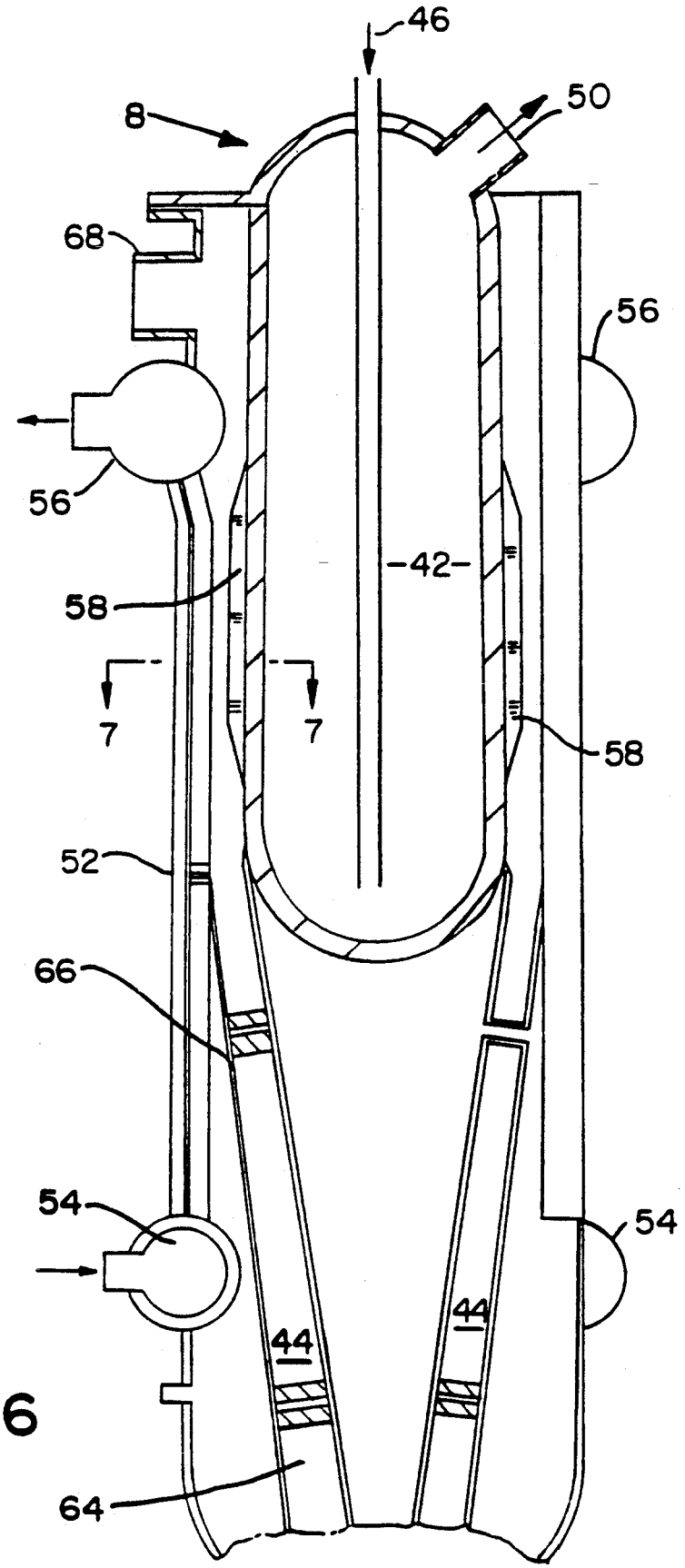
FIG. 6 is a sectional elevational view of the quench boiler of the apparatus.

As best seen in FIG. 6, the quench boilers 8 associated with the furnace 2 are configured with an internal cold side 42, external annular cold side 52 and a hot side 44. The internal cold side 42 is comprised of an inner chamber with a boiler feed water inlet 46 and a steam outlet 50. An annular boiler feed water inlet 54 facilitates delivery of coolant to the exterior cold side tubes 52 and an annulus 56 collects the heated coolant for use elsewhere. Fins 58 extend from the inner chamber into the hot side passage 44.

The hot side 44 of each quench boiler 8 is comprised of the effluent inlet 64 configured with a downstream diverging section 66 and an outlet 68.

The process of the present invention proceeds by heating hydrocarbon feed in the convection coils and delivering hydrocarbon feed to the radiant coils 16 in the superheater zone 20 at about 1150° F. The hydrocarbon feed is elevated in the superheater zone 20 to about a temperature of 1325° F. During the passage of the feed through the superheater zone 20, the residence time is about 80–130 maintaining the tube metal temperature of the coils 16 at or below about 1500° F. in the superheater zone 20. Conversion in the superheater zone 20 is maintained below, 20%, preferably below 10%.

Thereafter, the feed passes through the radiant coils 16 to the radiant zone 22 at about 1325° F. and is elevated to about 1650° F. at a residence time of about 40–90 milliseconds, preferably about 50 milliseconds and exits from the furnace discharge 28 at a conversion of about 65%.

Discharged effluent from the furnace 4 is passed to the adiabatic reactor 6 for residence time of less than about 30 milliseconds, preferably less than 20 milliseconds, wherein the temperature of the effluent drops to about 1625° F. in effecting a conversion of about 90%.

The converted effluent exits from the adiabatic reactor 6 at about 1625° F. and passes to the quench boilers 8 wherein the reactions are terminated. Coolant enters the quench boiler 8 through the coolant entries 54 and 46, travels through the quench boiler 8 and exits through coolant exits 56 and 50. The effluent temperature is reduced to below about 1100° F. in the quench boilers 8.

In practice it has been found that firing the burners 30 in the radiant zone 22 at about 2500 BTU/pound hydrocarbon will enable a temperature in the range of 2300° F. to be maintained in the radiant zone 22 and a temperature in the range of about 1800° C. to be maintained in the superheater zone 20. These furnace zone or furnace box temperatures provide a tube metal temperature of below about 1500° F. in the superheater zone 20 and a tube metal temperature of about 1625° F. in the adiabatic reactor 8 at product conversion.

The preferred quench boiler coolant comprises water boiling at about 1500 psig which enters through a coolant entry 46 and exits a stream at a coolant exit 50, cooling the hot process stream flowing through zone 44, as shown in FIG. 6.

The process affords fuel savings and furnace weight savings. With radiant heat providing the energy to elevate the temperature of the feed in the superheater section 20, the incipient cracking occurs under very efficient conditions. Heat from gases emanating from the radiant section 22 is used to begin the cracking reaction in the superheater zone 20. It is preferable in the process of the present invention that hydrocarbon feed conversion be kept below 10% in the superheater zone 20. Thus, as long as the conversion of the feed in the superheater section 20 is kept below 10%, the residence time will be a function of the heat available from the gases generated by the burners 30 in the radiant section. Realistically, the residence time of the feed in the superheater zone 20 can be from about 80 to about 130 milliseconds.

Thereafter, the feed entering the radiant zone 22 will be cracked rapidly to reach the partially cracked condition; i.e. 55% to 70% conversion. Residence times for process feed in the radiant zone 22 will be about 40 to about 90 milliseconds.

With conversion limited in the radiant zone 22 to less than complete conversion, complete (90%) conversion will occur in the adiabatic reactor 6. The process feed from the radiant zone 22 is manifolded from a plurality of coils 16 into conduits 34 which in turn are manifolded into a header 35 at the entry of the adiabatic reactor 6 and passes through the adiabatic reactor 6 at a residence time of 20 to 35 millisecond to effect the desired conversion.

The furnace 2 of the present invention will be considerably lighter in weight than conventional pyrolysis or thermal cracking furnaces. The radiant superheater zone 20 facilitates more effective heat transfer to the feedstock than conventional furnaces wherein convection tubes are used to effect a large amount of heat transfer to the feedstock. Further, the adiabatic reactor 6 enables a shorter coil length in the radiant zone 22 than required for conventional complete cracking within the furnace. In addition, the coil outlet of the furnace 2 is maintained at a lower temperature than conventional radiant furnace coil outlets, thereby reducing the coke make in the furnace.

The following Table 1 illustrates a comparison of the savings between the furnace 2 of the present invention and a conventional furnace, each having the capacity to produce 100 mm lb/year of $C_2H_4$.

TABLE 1

| | This Disclosure Furnace 2 | USC Conventional |
|---|---|---|
| Naphtha, 1000 lb/hr | 40 | 45 |
| Fuel, at equal power, mm BTU/hr | 115 | 150 |
| Heat Transfer, M-ft$^2$ Convective | 45 | 82 |
| Firebox Dimensions | | |
| Inner Vol., M-ft$^3$ | 8 | 17 |
| Outer Surface, M-ft$^2$ | 3.5 | 6.7 |
| Quench Boilers | | |
| Weight, lbs | 3,000 | 55,000 |
| Length, ft | 18 | 45 |

The following Table 2 further illustrates a prophetic example of the parameters of the present invention.

TABLE 2

| | SUPERHEATER | RADIANT REACTOR @ BEAM LENGTH 4 FT. | RADIANT REACTOR @ BEAM LENGTH 1.5 FT. | ADIABATIC REACTOR | TOTAL |
|---|---|---|---|---|---|
| lbs/hour/coil | | | | | |
| Naphtha | 700 | 700 | 1400 | 4200 | |
| Steam | 350 | 350 | 700 | 2100 | |

TABLE 2-continued

| | SUPERHEATER | RADIANT REACTOR @ BEAM LENGTH 4 FT. | 1.5 FT. | ADIABATIC REACTOR | TOTAL |
|---|---|---|---|---|---|
| Coil Lenqth, ft. | 35 | 30 | 5 | 5 | 75 |
| I.D., inch | 1.5 | 1.5 | 2.13 | 6.5/7.5 | |
| % n-Pentane conversion | | | | | |
| In | 0 | 6 | 48 | 65 | |
| Out | 6 | 48 | 65 | 90 | 90 |
| Residence Time, milliseconds | | | | | |
| Total | 115 | 52 | 7 | 20 | 194 |
| Plus 10% $nC_5$ conversion | 0 | 33 | 7 | 20 | 60 |
| Temperature, °F. | | | | | |
| Flue Gas | 1600 | 2300 | 2300 | | |
| Process Out | 1325 | 1615 | 1640 | 1610 | |
| Max. Metal Out | 1480 | 1915 | 1850 | 1610 | |
| Yield, wt % naphtha | | | | | |
| $CH_4$ | | | | | 15 |
| $C_2H_4$ | | | | | 31.5 |
| $C_3H_6$ | | | | | 15 |
| $C_4H_6$ | | | | | 4.5 |
| Total | | | | | 51.0 |
| Fuel Oil | | | | | 3 |
| Selectivity | | | | | 2.8 |

I claim:

1. A process for producing olefins from hydrocarbon feed selected from naphtha, atmospheric gas oils and vacuum gas coils comprising the steps of delivering hydrocarbon feed to process coils passing through an unfired radiant superheater zone heated with radiant heat from the flue gases of a downstream fired radiant zone; and delivering the hydrocarbon feed from the unfired radiant superheater zone to a fired radiant zone in the process coils extending from the superheater zone through the fired zone.

2. A process as in claim 1 further comprising the step of delivering the hydrocarbon feed from the fired radiant zone to an adiabatic reactor.

3. A process as in claim 2 further comprising the step of heating the hydrocarbon feed by convection before delivering the feed to the unfired radiant superheater zone.

4. A process as in claim 3 further comprising the step of indirectly quenching the effluent from the adiabatic reactor to terminate the reactions in the effluent.

5. A process as in claim 4 wherein said adiabatic reactor is in a venturi configuration and reduces the hot product gas velocity from the fired radiant zone from about 800 to about 250 ft/second.

6. A process as in claim 2 wherein the firebox temperature in the unfired radiant superheater is less than 1850° F., the coil tube metal temperature is less than 1450° F. and the conversion of the hydrocarbon feed is less than 10%; the firebox temperature of the fired radiant zone is less than 2300° F., the coil tube metal temperature is less than 1865° F. and the conversion of the hydrocarbon feed is less than 65%.

7. A process as in claim 4 wherein the tube metal temperature in the adiabatic reactor is less than about 1650° F. and the hydrocarbon conversion is about 90%.

8. A process as in claim 7 wherein the residence time in the unfired radiant superheater zone is about 80 to 130 milliseconds; the residence time in the fired radiant zone is about 40 to 90 milliseconds and the residence time in the adiabatic reactor is less than about 30 milliseconds.

9. A process as in claim 8 wherein the fired radiant zone is fired at about 2500 Btu/lb of hydrocarbon and the conversion of hydrocarbon feed is at least 90%.

10. A process for producing olefins from hydrocarbon feed selected from naphtha, atmospheric gas oils and vacuum gas oils comprising the following steps:

delivering hydrocarbon feed to process coils passing through an unfired radiant superheater zone heated with radiant heat from the flue gases of a downstream fired radiant zone to convert less than 20% of the hydrocarbon feed; and delivering the partially converted hydrocarbon feed from the unfired radiant superheater zone to a fired radiant zone in process coils extending from the superheater zone through the fired radiant zone to provide an exit conversion of said feed of less than 65%.

* * * * *